US010059112B2

(12) United States Patent
Shibata

(10) Patent No.: US 10,059,112 B2
(45) Date of Patent: Aug. 28, 2018

(54) LIQUID DISCHARGING APPARATUS

(71) Applicant: SEIKO EPSON CORPORATION, Tokyo (JP)

(72) Inventor: Yohei Shibata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/601,866

(22) Filed: May 22, 2017

(65) Prior Publication Data

US 2017/0334208 A1 Nov. 23, 2017

(30) Foreign Application Priority Data

May 23, 2016 (JP) ..... 2016-102171

(51) Int. Cl.

| | |
|---|---|
| ***B41J 2/165*** | (2006.01) |
| ***B41J 11/057*** | (2006.01) |
| *B41J 2/04* | (2006.01) |
| *B41J 11/04* | (2006.01) |

(52) U.S. Cl.

CPC ..... *B41J 2/16526* (2013.01); *B41J 11/057* (2013.01); *B41J 2/1652* (2013.01); *B41J 11/04* (2013.01); *B41J 2002/041* (2013.01); *B41J 2002/16529* (2013.01)

(58) Field of Classification Search

CPC ..... B41J 2/16526; B41J 11/057; B41J 2002/041; B41J 11/04; B41J 2/1652; B41J 2002/16529

See application file for complete search history.

(56) References Cited

U.S. PATENT DOCUMENTS

| | | | | |
|---|---|---|---|---|
| 2005/0151815 | A1* | 7/2005 | Kanai | B41J 2/2107 347/102 |
| 2012/0242744 | A1* | 9/2012 | Sutton | B41J 11/0065 347/31 |
| 2014/0165865 | A1 | 6/2014 | Chover Lopez et al. | |
| 2015/0009269 | A1 | 1/2015 | Sasaki | |

FOREIGN PATENT DOCUMENTS

| | | | | |
|---|---|---|---|---|
| JP | 2004-155182 | * | 6/2004 | B41J 2/18 |
| JP | 2004-230806 | | 8/2004 | |
| JP | 2009-000931 | | 1/2009 | |
| JP | 2012-121192 | | 6/2012 | |
| JP | 2014-104604 | | 6/2014 | |
| JP | 2015-013446 | | 1/2015 | |

* cited by examiner

*Primary Examiner* — Henok Legesse

(74) *Attorney, Agent, or Firm* — Workman Nydegger

(57) ABSTRACT

The printing apparatus (liquid discharging apparatus) is provided with a support section that supports a medium, a discharge section that discharges ink on the medium supported on the support section, and a transport unit that transports the medium in a transport direction. The support section includes a support structure including a liquid permeable portion that supports the medium and allows ink to pass therethrough, and a liquid holding portion that holds ink that has passed through the liquid permeable portion.

9 Claims, 9 Drawing Sheets

LIQUID DISCHARGING APPARATUS

BACKGROUND

1. Technical Field

The present invention relates to a liquid discharging apparatus such as an ink jet printer.

2. Related Art

In the related art, ink jet printing apparatuses are known that perform printing by discharging liquid, an example thereof being ink, on a surface of a medium such as a sheet supported on a support section (platen). Some of such printing apparatuses include a support section interchangeable depending on the type of medium on which printing is to be performed (e.g. US 2014/0165865 (A1)). For example, a support section capable of absorbing ink (absorbent platen) is used when printing is performed on a mesh-like medium such as fabric and the like. In such a printing apparatus, when printing is performed on a mesh-like medium, ink that passes through the medium, of the ink discharged toward to the medium, is absorbed by the support section.

However, in printing apparatuses such as that described above, when printing is performed on a mesh-like medium supported on a support section capable of absorbing ink, a back surface of the medium rubs against the support section, which has absorbed the ink, during transportation of the medium. Consequently, the ink absorbed by the support section may adhere to the back surface of the medium as a result of transporting the medium.

An advantage of an aspect of the invention is to provide a liquid discharging apparatus capable of preventing liquid from adhering to the back surface of a medium, even when the medium on which the liquid is to be discharged is transported while supported on a support section.

SUMMARY

Hereinafter, a description is given of the means for solving the problem and the advantages of the invention.

A liquid discharging apparatus according to an aspect of the invention includes a support section configured to support a medium, a discharge section configured to discharge liquid on the medium supported on the support section, and a transport unit configured to transport the medium in a transport direction. In such a liquid discharging apparatus, the support section includes a support structure including a liquid permeable portion configured to support the medium and allow liquid to pass therethrough, and a liquid holding portion configured to hold the liquid that has passed through the liquid permeable portion.

According to this configuration, of the liquid discharged toward the mesh-like medium supported on the support structure, liquid that has passed through the medium is held in the liquid holding portion after passing through the liquid permeable portion supporting the medium. As such, states in which liquid adheres to portions of the liquid permeable portion that support the medium are less prone to persist. Therefore, the liquid does not easily adhere to the back surface of the medium, even when the medium is transported. Accordingly, liquid can be prevented from adhering to the back surface of the medium, even when the medium on which the liquid is to be discharged is transported while supported on the support section.

In the liquid discharging apparatus described above, it is preferable that the liquid holding portion be a liquid absorbing portion configured to hold liquid by absorbing the liquid.

According to this configuration, liquid that has passed through the liquid permeable portion is absorbed and held by the liquid absorbing portion. As such, compared to cases where the liquid holding portion is a recess capable of storing liquid, or the like, the liquid held by the liquid holding portion (the liquid absorbing portion) can be prevented from leaking in the vicinity of the support structure.

In the liquid discharging apparatus described above, it is preferable that the support section include a support surface configured to support the medium, and the support structure be detachably disposed on the support surface.

According to this configuration, a state in which the support surface supports the medium and a state in which the support structure disposed on the support section supports the medium can be selected, depending on whether or not the support structure is to be disposed on the support surface. That is, even when liquid is to be discharged on different types of media, support modes suited to the different types of media can be selected.

In the liquid discharging apparatus described above, it is preferable that the support section include an oblique portion detachably disposed on the support surface and configured to guide the medium to the support structure disposed on the support surface.

When the support structure is disposed on the support surface of the support section, a step may be created in the transport path of the medium as a result of disposing the support structure. Here, according to this configuration, when the support structure is disposed on the support surface of the support section, this step in the transport path of the medium can be eliminated by further disposing the oblique portion. Accordingly, the risk of transport failure of the medium occurring at the support section on which the support structure is disposed can be reduced.

According to another aspect of the invention, the liquid discharging apparatus further includes a first heating unit configured to heat the medium prior to being supported on the support section, and a second heating unit configured to heat the support section to heat the medium supported on the support section. In such a liquid discharging apparatus, it is preferable that the amount of heat transferred to the medium by the first heating unit be increased when the support structure is disposed on the support surface compared to when the support structure is not disposed on the support surface.

In liquid discharging apparatuses, in order to dry a medium on which liquid has been discharged or react the liquid discharged on the medium, the medium may be heated. When the support structure is disposed on the support surface, the temperature of the support section does not easily rise when the support section is heated, and the amount of heat transferred from the support section to the medium tends to be smaller. Here, according to this configuration, the amount of heat transferred to the medium by the first heating unit is increased when the support structure is disposed on the support surface compared to when the support structure is not disposed on the support surface. As such, reductions in the amount of heat transferred to the medium at the support section can be compensated by the driving of the first heating unit. Thus, occurrences of heating deficiencies of the medium at the support section can be suppressed.

BRIEF DESCRIPTION OF THE DRAWINGS

The invention will be described with reference to the accompanying drawings, wherein like numbers reference like elements.

DESCRIPTION OF EMBODIMENTS

An exemplary embodiment in which a liquid discharging apparatus is embodied in a printing apparatus is described below with reference to the accompanying drawings. Note that the printing apparatus of the present exemplary embodiment is an ink jet printer that prints characters and images by discharging liquid, an example thereof being ink, on a medium such as a sheet.

Figure 1:
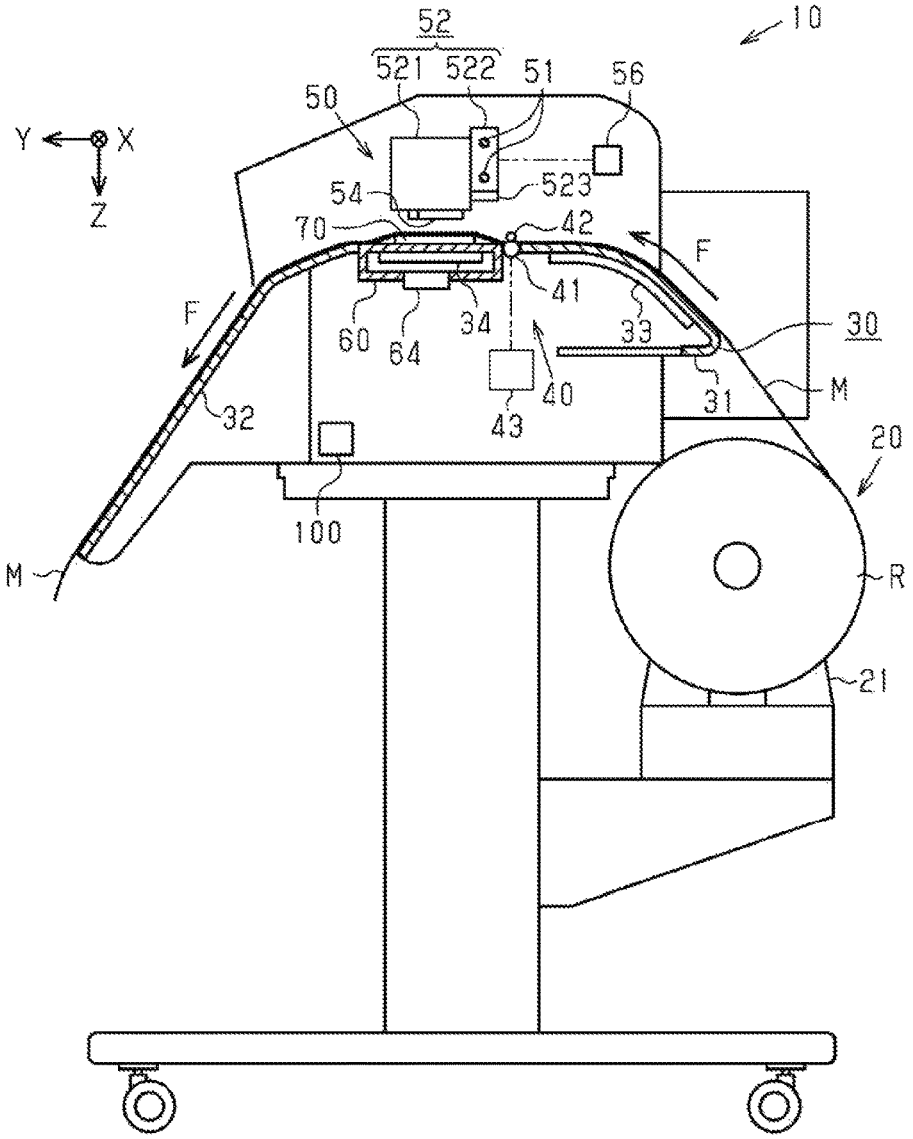
FIG. 1 is a side view of a printing apparatus according to an exemplary embodiment.

As illustrated in FIG. 1, a printing apparatus 10 is provided with a feeding unit 20 that feeds a medium M, a guide unit 30 that guides the medium M, a transport unit 40 that transports the medium M, a printing unit 50 that prints on the medium M, and a control unit 100 that controls these constituents.

In the following description, a width direction of the printing apparatus 10 is referred to as a "width direction X", a front-back direction of the printing apparatus 10 is referred to as a "front-back direction Y", a vertical direction of the printing apparatus 10 is referred to as a "vertical direction Z", and a direction in which the medium M is transported is referred to as a "transport direction F." The width direction X, the front-back direction Y, and the vertical direction Z are directions that cross (are orthogonal to) each other, and the transport direction F is a direction that crosses (is orthogonal to) the width direction X.

The feeding unit 20 includes a holding member 21 that rotatably holds a roll R on which the medium M is wound. The holding member 21 holds different types of media M and rolls R with different dimensions in the width direction X. Moreover, the medium M is unwound from the roll R and fed toward the guide unit 30 by rotating the roll R in one direction (the counter-clockwise direction in FIG. 1) at the feeding unit 20.

Figure 2:
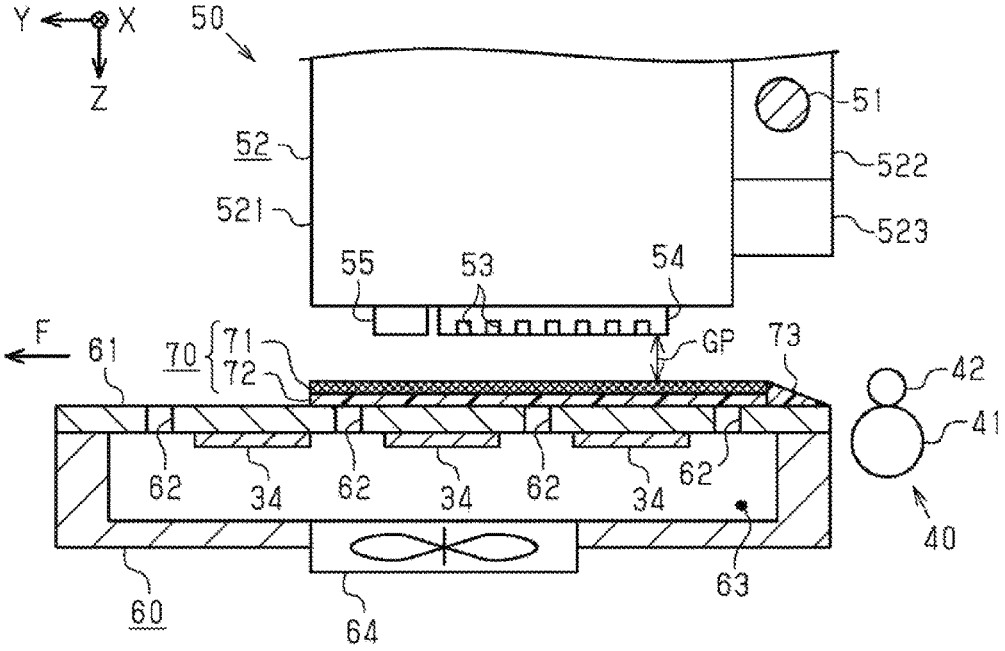
FIG. 2 is a side view of a printing unit and support section of the printing apparatus.

The guide unit 30 is provided with, from upstream toward downstream in the transport direction F, a first guide section 31, a support section 60, and a second guide section 32. These sections form the transport path of the medium M. The first guide section 31 guides the medium M fed from the feeding unit 20 toward the support section 60, the support section 60 supports the medium M on which printing is to be performed, and the second guide section 32 guides, downstream in the transport direction F, the medium M on which printing has been performed. Note that in the following description, as illustrated in FIG. 2, a surface of the support section 60 that comes into contact with the back surface of the medium M to support the medium M is referred to as a "support surface 61."

As illustrated in FIG. 1, a first heating unit 33 that heats the first guide section 31 is provided on a side of the first guide section 31 opposite the transport path of the medium M; and a second heating unit 34 that heats the support section 60 is provided on a side of the support section 60 opposite the transport path of the medium M. The first heating unit 33 is configured to heat the first guide section 31 to heat the medium M guided (supported) by the first guide section 31; and the second heating unit 34 is configured to heat the support section 60 to heat the medium M guided (supported) by the support section 60. In other words, the first heating unit 33 and the second heating unit 34 are configured to indirectly transmit heat (transfer heat) to the medium M via the first guide section 31 and the support section 60, respectively.

The first heating unit 33 and the second heating unit 34 heat the medium M from before to after the printing to promote drying of the medium M and react the ink discharged on the medium M, which promotes the fixing of the ink to the medium M. Note that the first heating unit 33 and the second heating unit 34 may be seat heaters (surface heaters), cord heaters (heater wires), or other types of heaters.

Heating modes of the first heating unit 33 and the second heating unit 34 are controlled on the basis of target temperatures to which the heating subjects, namely the first guide section 31 and the support section 60, are heated. In the following description, the target temperature of the first heating unit 33 is referred to as a "first target temperature" and the target temperature of the second heating unit 34 is referred to as a "second target temperature."

The transport unit 40 is provided with a transport roller 41 that applies transporting force to the medium M, a driven roller 42 that presses the medium M against the transport roller 41, and a drive mechanism 43 that rotationally drives the transport roller 41. The transport roller 41 and the driven roller 42 have the width direction X as axial directions. Additionally, the transport roller 41 is disposed vertically below the transport path of the medium M, and the driven roller 42 is disposed vertically above the transport path of the medium M. The drive mechanism 43 may be configured as a motor, a reduction gear, or the like. Moreover, the transport unit 40 transports the medium M in the transport direction F by rotating the transport roller 41 while the medium M is sandwiched between the transport roller 41 and the driven roller 42.

As illustrated in FIG. 1 and FIG. 2, the printing unit 50 is provided with a guide shaft 51 having the width direction X as an axial direction, a carriage 52 supported on the guide shaft 51 and movable in the width direction X, and a discharge section 54 including nozzles 53 that discharge ink on the medium M. Additionally, the printing unit 50 is provided with a detection section 55 that detects whether or not the medium M is present on the support surface 61, and a movement mechanism 56 that moves the carriage 52 in the width direction X. The carriage 52 includes a main carriage 521 that supports the discharge section 54, a sub carriage 522 that supports the main carriage 521, and a raising/lowering mechanism 523 that raises and lowers the main carriage 521.

As illustrated in FIG. 2, the main carriage 521 supports the discharge section 54 and the detection section 55 so that the discharge section 54 and the detection section 55 face the support section 60. Additionally, the guide shaft 51 is inserted through the sub carriage 522 in the width direction X, and the sub carriage 522 moves in the width direction X on the basis of the driving of the movement mechanism 56. Note that in the exemplary embodiment, the main carriage 521 is disposed on the downstream side in the transport direction F, and the sub carriage 522 is disposed on the upstream side in the transport direction F.

The raising/lowering mechanism 523 may have a configuration including a motor and a power transmission mechanism that converts rotational motion of the motor into linear motion of the main carriage 521. Note that here, the term "power transmission mechanism" refers to a cam mechanism, a rack and pinion mechanism, or the like, for example. Moreover, the raising/lowering mechanism 523 adjusts space (hereinafter referred to as a "gap GP") between the discharge section 54 and the support section 60 by moving the main carriage 521 relative to the sub carriage 522.

The discharge section 54 is an ink jet head that discharges liquid, an example thereof being ink, from the nozzles 53. The discharge section 54 discharges ink such as cyan ink, magenta ink, yellow ink, or black ink toward the medium M supported on the support section 60. Additionally, the discharge section 54 may include nozzles 53 that discharge liquid other than ink such as a pretreatment agent or a post-treatment agent that promotes the fixability of the ink to the medium M.

The detection section 55 is a reflective optical sensor, for example, and detects whether or not the medium M or the like is present in a detection subject area on the support surface 61 of the support section 60. Here, the term "detection subject area of the detection section 55" refers to an area on the support surface 61 that faces the detection section 55 supported on the carriage 52 when the carriage 52 moves in the width direction X.

The movement mechanism 56 may have a configuration including a motor and a power transmission mechanism that converts rotational motion of the motor into linear motion of the carriage 52. Note that here, the power transmission mechanism includes, for example, a plurality of pulleys, a motor that drives at least one pulley, and a belt wound around the plurality of pulleys.

Next, with reference to FIG. 2, a detailed description will be given of the support section 60 including a support structure used depending on the type of the medium M.

Figure 3:
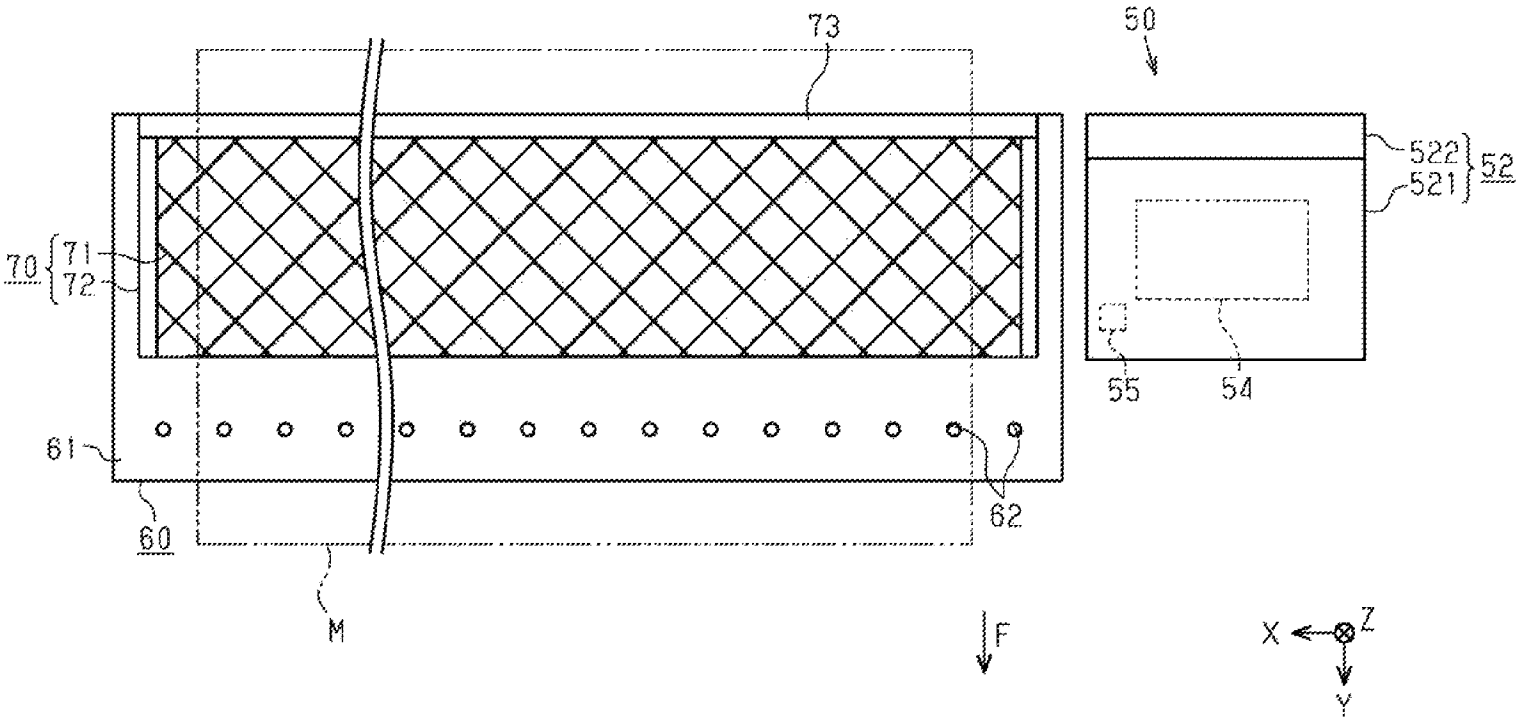
FIG. 3 is a plan view of the printing unit and support section of the printing apparatus.

As illustrated in FIG. 2 and FIG. 3, a plurality of suction ports 62 open on the support surface 61 and a negative pressure chamber 63 in communication with the suction ports 62 are formed in the support section 60. Additionally, the support section 60 includes a depressurizing unit 64 that depressurizes the negative pressure chamber 63. The plurality of suction ports 62 are open and aligned in the width direction X and the front-back direction Y on the support surface 61. The depressurizing unit 64 may be a suction pump or the like, for example, and depressurizes the negative pressure chamber 63 by suctioning gas from the negative pressure chamber 63. Moreover, the negative pressure chamber 63 is depressurized by driving the depressurizing unit 64 to cause gas to be suctioned through the suction ports 62 in communication with the negative pressure chamber 63 at the support section 60, which causes a suction attachment force for attaching the medium M to act on the support surface 61.

Additionally, as illustrated in FIG. 2 and FIG. 3, the support section 60 is provided with a support structure 70 and an oblique portion 73, detachably disposed on the support surface 61. The support structure 70 is disposed in an area of the support surface 61 capable of facing the discharge section 54 supported on the carriage 52 that moves in the width direction X, and the oblique portion 73 is disposed on the support surface 61 upstream in the transport direction F of the support structure 70.

As illustrated in FIG. 3, the support structure 70 has a sheet-like form having the length in the longitudinal direction that is substantially the same as the length in the width direction X of the support section 60. Additionally, as illustrated in FIG. 2, the support structure 70 is provided with a liquid permeable portion 71 (liquid permeable layer) through which ink passes, and a liquid absorbing portion 72 (liquid absorbing layer) that absorbs and holds ink that has passed through the liquid permeable portion 71.

In the support structure 70, a surface of a side of the liquid permeable portion 71 opposite the liquid absorbing portion 72 (front surface) is a surface that comes into contact with the back surface of the medium M to support the medium M. On the other hand, a surface of a side of the liquid absorbing portion 72 opposite the liquid permeable portion 71 (back surface) is an adhesion surface on which an adhesive is applied and which can be affixed to the support surface 61 of the support section 60.

As illustrated in FIG. 3, the liquid permeable portion 71 has a network form and allows liquid to pass through the meshes thereof. Additionally, the liquid permeable portion 71 is provided in close contact to the liquid absorbing portion 72 in a thickness direction of the support structure 70. Note that it is preferable that the liquid permeable portion 71 have ink resistance and be formed from a metal material, a resin material, or the like that has rigidity sufficient to support the medium M.

Additionally, it is preferable that an area of the liquid permeable portion 71 that comes into contact with the medium M when supporting the medium M be small. For example, of the area of the surface of the liquid permeable portion 71, when an area that comes into contact with the medium M to support the medium M is a contact area and the other area constituting the meshes that does not come into contact with the medium M is a non-contact area, it is preferable that the non-contact area be larger than the contact area. Specifically, it is preferable that the proportion of the non-contact area to the sum area of the contact area and the non-contact area be 75% or greater. Note that the term "non-contact area" can also be expressed as the area through which ink can pass of the area of the surface of the liquid permeable portion 71 (the support structure 70).

The liquid absorbing portion 72 is formed in a sheet-like form from a material capable of absorbing ink. Here, when the liquid absorbing portion 72 is formed from a woven fabric formed from a myriad of fibers, there is a risk that fibers dropped from the liquid absorbing portion 72 will adhere to the nozzles 53 of the discharge section 54 and affect the discharge performance of the discharge section 54.

As such, it is preferable that the liquid absorbing portion 72 be formed from a material from which fibers do not easily drop such as a nonwoven fabric made of cupra long fibers or the like, or absorbent polymers.

The oblique portion 73 has a length in the width direction X substantially the same as the length of the support structure 70 in the width direction X. The oblique portion 73 is disposed on the upstream side in the transport direction F of the support structure 70, and the slope thereof separates away from the support surface 61 with progression along the transport direction F. Thus, the oblique portion 73 eliminates the step between the support surface 61 and the support structure 70 disposed on the support surface 61, and guides the medium M to the support structure 70 disposed on the support surface 61. Note that the oblique portion 73 may be disposed on the downstream side in the transport direction F of the support structure 70.

Next, a description of the control unit 100 of the printing apparatus will be given while referencing FIG. 4.

Figure 4:
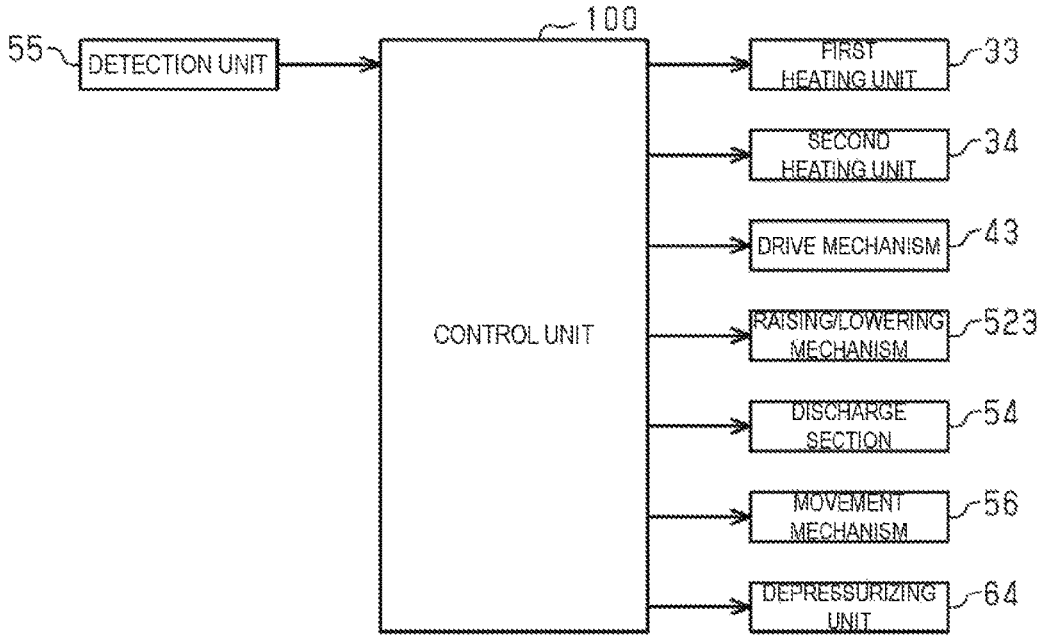
FIG. 4 is a block diagram illustrating an electrical configuration of the printing apparatus.

As illustrated in FIG. 4, the detection section 55 is connected to an input-side interface of the control unit 100, and the first heating unit 33, the second heating unit 34, the drive mechanism 43, the raising/lowering mechanism 523, the discharge section 54, the movement mechanism 56, and the depressurizing unit 64 are connected to an output-side interface of the control unit 100.

The control unit 100 causes printing to be performed on the medium M on the basis of a print job input from a terminal (not illustrated). Specifically, the control unit 100 causes a transport operation, in which the medium M is transported by a unit transport amount in the transport direction F, and a discharge operation, in which ink is discharged from the discharge section 54 toward the medium M while moving the carriage 52 in the width direction X, to be alternately performed. Additionally, for example, prior to starting the printing, the control unit 100 drives the raising/lowering mechanism 523 in order to set the space (the gap GP) between the discharge section 54 and the medium M to a suitable space (hereinafter also referred to as an "appropriate gap"), and drives the depressurizing unit 64 when necessary to attach the medium M to the support surface 61.

The control unit 100 determines, for example, whether or not the medium M is placed in the detection subject area of the detection section 55 on the support surface 61 or whether or not the support structure 70 is attached to the detection subject area on the basis of detection results of the detection section 55. For example, when the reflectances of the medium M, the support surface 61, and the support structure 70 differ from each other, the control unit 100 determines, for example, whether or not the medium M is placed in the detection subject area or whether or not the support structure 70 is attached to the detection subject area on the basis of the reflectance of the detection subject area calculated on the basis of the detection results of the detection section 55. Additionally, when the thicknesses of the medium M and the support structure 70 differ from each other, the control unit 100 determines, for example, whether or not the medium M is placed on the support section 60 or whether or not the support structure 70 is attached to the support surface 61 on the basis of a distance from the detection section 55 to the detection subject area calculated on the basis of detection results of the detection section 55.

Next, a description will be given of types of the medium M on which printing is to be performed by the printing apparatus 10, and support modes of the medium M depending on these types. Note that in the following description, ink "passing through" the medium M means that ink reaches the back side of the medium M from the front side of the medium M by passing through gaps between the fibers forming the medium M. Additionally, ink "passing through" the liquid permeable portion 71 means that ink passes through the meshes of the liquid permeable portion 71.

The medium M, which is the printing subject of the printing apparatus 10 of the exemplary embodiment, includes a regular medium M, namely a sheet or film with comparatively narrow gaps between the fibers or polymers forming the medium M and through which gas does not easily pass; and also a mesh-like medium M such as fabric with comparatively wide gaps between the threads or fibers forming the medium M and through which gas easily passes.

Here, when printing is performed on the regular medium M, ink discharged toward the medium M supported on the support surface 61 does not easily pass through the medium M and, thus, the ink does not easily adhere to the support surface 61. Accordingly, in this case, printing quality can be enhanced by attaching the medium M to the support surface 61 to stabilize the posture of the medium M on which ink is to be discharged.

On the other hand, when printing is performed on the mesh-like medium M, ink discharged toward the medium M supported on the support surface 61 easily passes through the medium M and, thus, the ink easily adheres to the support surface 61. That is, when printing is performed on the mesh-like medium M supported on the support surface 61, the medium M transported in the transport direction F rubs against the support surface 61 to which ink has adhered. Consequently, printing quality is prone to decline due to the back surface of the medium M becoming soiled with ink, ink adhered to the back surface of the medium M soaking into the medium M, and the like.

Accordingly, when printing is performed on the mesh-like medium M, it is preferable that the support structure 70, which is capable of absorbing and holding ink, be disposed on the support section 60 to prevent the ink, which has passed through the medium M, from adhering to the back surface of the medium M. Incidentally, even if the depressurizing unit 64 is driven without disposing the support structure 70 on the support surface 61 when printing is performed on the mesh-like medium M, the medium M cannot be attached to the support surface 61 because gas passes through the medium M supported on the support surface 61.

As described above, in the exemplary embodiment, the user of the printing apparatus 10 selects whether or not to dispose the support structure 70 on the support surface 61 depending on whether the medium M is the regular medium M or the mesh-like medium M. Additionally, the control unit 100 changes printing conditions depending on whether or not the support structure 70 is disposed on the support surface 61.

Figure 5:
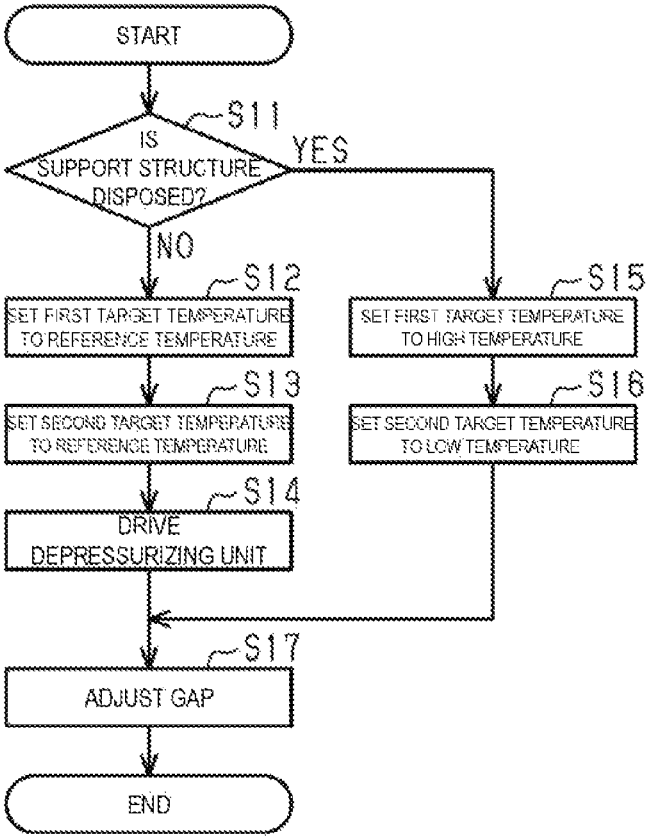
FIG. 5 is a flowchart explaining a processing routine executed by a control unit of the printing apparatus to change printing conditions.

Next, a processing routine executed by the control unit 100 to change the printing conditions is described while referencing the flowchart illustrated in FIG. 5.

As illustrated in FIG. 5, the control unit 100 determines whether or not the support structure 70 is disposed on the support surface 61 on the basis of the detection results of the detection section 55 (step S11). When the support structure 70 is not disposed on the support surface 61 (step S11: NO), the control unit 100 sets the first target temperature of the first heating unit 33 to a reference temperature (step S12) and sets the second target temperature of the second heating unit 34 to the reference temperature (step S13). Then, the control unit 100 drives the depressurizing unit 64 to cause suction attachment forces to act on the support surface 61 (step S14), and proceeds to the processing of step S17 (described hereinafter).

On the other hand, when the support structure 70 is disposed on the support surface 61 (step S11: YES), the control unit 100 sets the first target temperature of the first heating unit 33 to a temperature higher than the reference temperature (step S15) and sets the second target temperature of the second heating unit 34 to a temperature lower than the reference temperature (step S16). That is, the driving of the first heating unit 33 is increased and the driving of the second heating unit 34 is decreased when the support structure 70 is disposed on the support surface 61, compared to when the support structure 70 is not disposed on the support surface 61. Then, the control unit 100 proceeds to the processing of the next step S17 without driving the depressurizing unit 64.

In step S17, the control unit 100 adjusts the space, namely the gap GP, between the discharge section 54 and the support section 60. Specifically, when the support structure 70 has been removed from the support surface 61, causing the gap GP between the discharge section 54 and the support structure 70 to be larger than the appropriate gap, the raising/lowering mechanism 523 is driven to adjust the gap GP to the appropriate gap. Additionally, when the support structure 70 has been provided on the support surface 61, causing the gap GP between the discharge section 54 and the support structure 70 to be smaller than the appropriate gap, the raising/lowering mechanism 523 is driven to adjust the gap GP to the appropriate gap. Thereafter, the control unit 100 terminates the processing routine.

Next, a description of the operation of the printing apparatus 10 of the exemplary embodiment will be given with reference to FIG. 6 and FIG. 7. Note that the solid arrow line in FIG. 6 represents the flow of gas.

Figure 6:
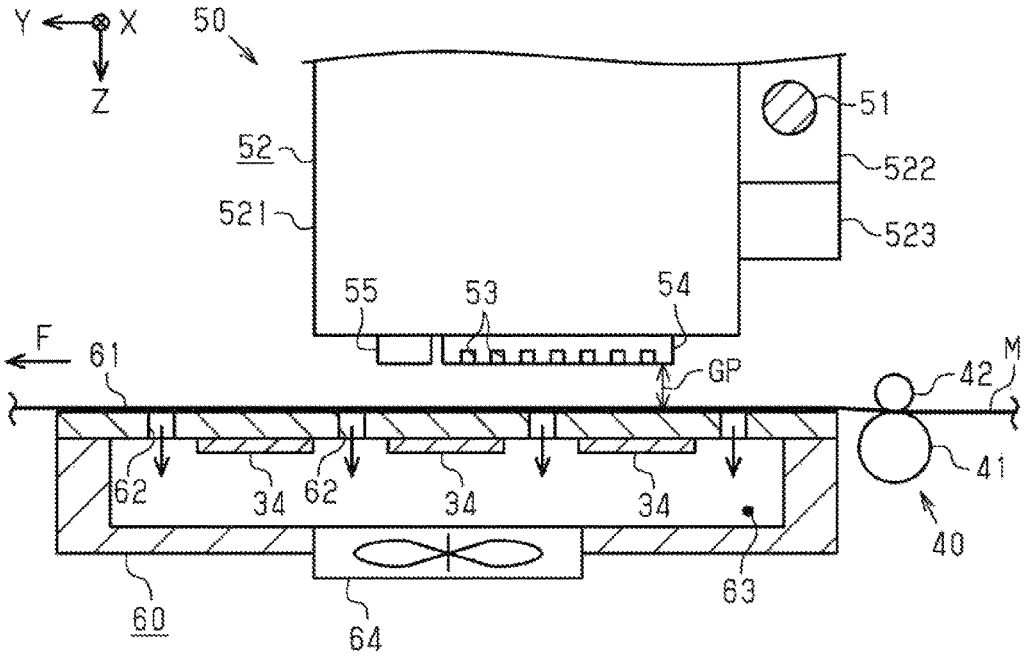
FIG. 6 is a side view of the printing unit and support section when printing is performed on a normal medium.

As illustrated in FIG. 6, when printing is performed on the regular medium M, the printing apparatus 10 of the exemplary embodiment is placed in a state in which the support structure 70 is not disposed on the support surface 61. As such, the first heating unit 33 and the second target temperature of the second heating unit 34 are set to the reference temperature, and the depressurizing unit 64 is driven to attach the medium M to the support surface 61. Additionally, when the gap GP is not the appropriate gap, the raising/lowering mechanism 523 is driven to adjust the gap GP to the appropriate gap.

The medium M is fed from the feeding unit 20, transported in the transport direction F to the transport unit 40, and reaches the support section 60. Then, the medium M is attached to the support surface 61 by the suction attachment forces acting on the support surface 61. Then, printing is performed by discharging ink toward the medium M with the medium M attached to the support surface 61 to stabilize its posture. Additionally, the medium M is heated prior to printing by heat transferred from the first guide section 31, and the medium M is heated during printing by heat transferred from the support section 60. As a result, fixing of images printed on the medium M is promoted.

Figure 7:
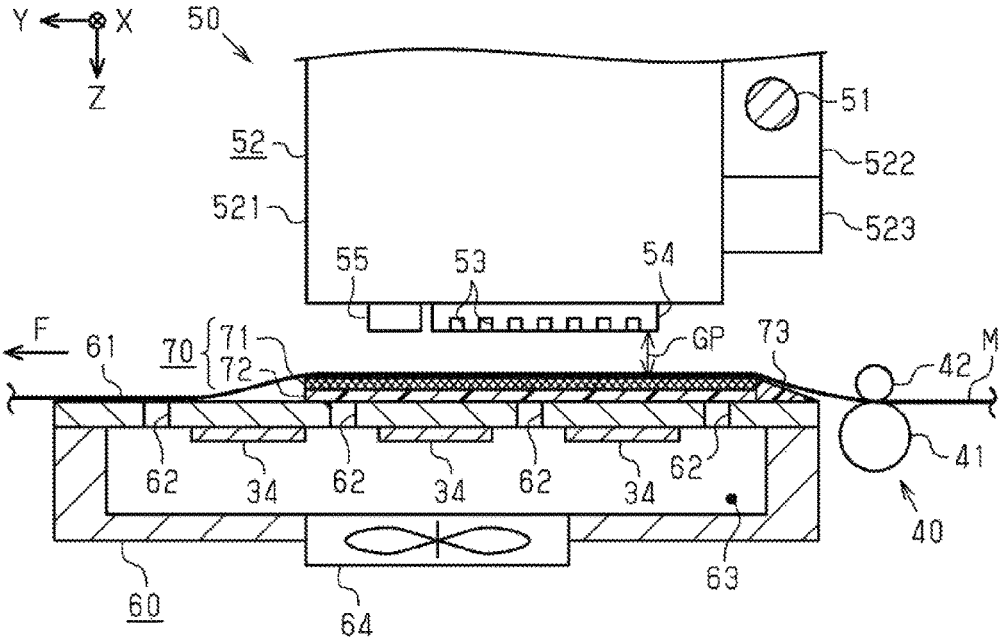
FIG. 7 is a side view of the printing unit and support section when printing is performed on a mesh-like medium.

On the other hand, as illustrated in FIG. 7, when printing is performed on the mesh-like medium M, the support structure 70 and the oblique portion 73 are disposed on the support surface 61. As such, the first target temperature of the first heating unit 33 is set to a temperature higher than the reference temperature and the second target temperature of the second heating unit 34 is set to a temperature lower than the reference temperature. When the support structure 70 is disposed on the support surface 61, the depressurizing unit 64 is not driven because the medium M cannot be attached to the support surface 61. Additionally, when the gap GP is not the appropriate gap, the raising/lowering mechanism 523 is driven to adjust the gap GP to the appropriate gap.

Figure 8:
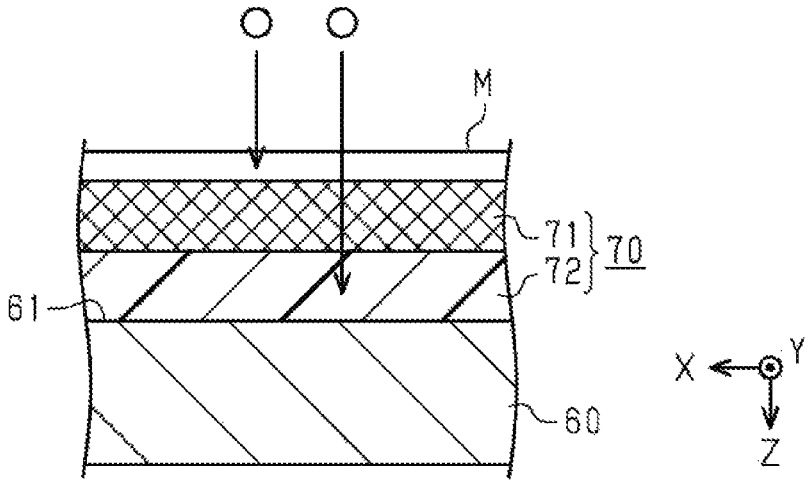
FIG. 8 is a side view illustrating how ink is discharged toward the mesh-like medium.

The medium M is fed from the feeding unit 20, transported in the transport direction F to the transport unit 40, and reaches the support section 60. Then, the medium M is positioned on the support structure 70. Next, printing is performed by discharging ink toward the medium M supported on the support structure 70. As such, as illustrated in FIG. 8, the ink that does not pass through the medium M becomes fixed to the medium M, and the ink that has passed through the medium M passes through the liquid permeable portion 71 of the support structure 70 and then is absorbed by the liquid absorbing portion 72 of the support structure 70. That is, ink that has passed through the medium M is less prone to remain on the surface of the support structure 70, and the ink that has passed through the liquid permeable portion 71 is prevented from adhering to the medium M that is transported in the transport direction F on the support structure 70 (the liquid permeable portion 71). Additionally, the ink absorbed by the liquid absorbing portion 72 is held by the liquid absorbing portion 72 and, as such, migration of this ink to the surface of the liquid permeable portion 71 is suppressed.

The support structure 70 is provided when printing is performed on the mesh-like medium M. Consequently, the amount of heat transferred from the support surface 61 to the medium M during printing is smaller, and thus, the temperature of the medium M during printing is prone to decline. However, in the exemplary embodiment, the first target temperature of the first heating unit 33 is set to a temperature higher than the reference temperature and, as a result, the temperature of the medium M that has reached the support section 60 becomes higher. Specifically, the amount of heat transferred from the first guide section 31 to the medium M is increased when the amount of heat transferred from the support section 60 to the medium M is smaller. As a result, reductions in the temperature of the medium M supported on the support section 60 are suppressed, and weakening of the fixing of the ink to the medium M is suppressed.

According to the exemplary embodiment described above, the following advantageous effects can be obtained.

(1) The support structure 70 including the liquid permeable portion 71 and the liquid absorbing portion 72 is disposed on the support surface 61 of the support section 60. As such, of the ink discharged toward the mesh-like medium M supported on the support structure 70, ink that has passed through the medium M is absorbed (held) by the liquid absorbing portion 72 after passing through the liquid permeable portion 71 supporting the medium M. Accordingly, states in which the ink adheres to portions of the liquid permeable portion 71 that support the medium M are less prone to persist, and the ink does not easily adhere to the back surface of the medium M during transportation of the medium M. Thus, the ink can be prevented from adhering to the back surface of the medium M, even when the medium M is transported after the ink has been discharged on the medium M supported on the support section 60.

(2) The ink that has passed through the liquid permeable portion 71 is absorbed by the liquid absorbing portion 72. Therefore, compared to cases where the liquid absorbing portion 72 is a recess capable of storing ink, or the like, the ink held by the liquid holding portion (the liquid absorbing portion 72) can be prevented from leaking in the vicinity of the support structure 70.

(3) The support structure 70 is configured to be detachable with respect to the support surface 61. Therefore, a state in which the support surface 61 supports the medium M and a state in which the support structure 70 disposed on the support section 60 supports the medium M can be selected, depending on whether or not the support structure 70 is to be disposed on the support surface 61. That is, states suited to printing on the medium M can be selected depending on the type of the medium M (the regular medium M or the mesh-like medium M).

(4) When the support structure 70 is disposed on the support surface 61, a step may be created in the transport path on the support surface 61. Here, in the exemplary embodiment, when the support structure 70 is disposed on the support surface 61 of the support section 60, this step in the transport path of the medium M can be eliminated by further disposing the oblique portion 73. Accordingly, the risk of transport failure of the medium M occurring at the support section 60 on which the support structure 70 is disposed can be reduced.

(5) When the support structure 70 is disposed on the support surface 61, the temperature of the support section 60 does not easily rise when the support section 60 is heated, and the amount of heat transferred from the support section 60 to the medium M tends to be smaller. Here, in the exemplary embodiment, the amount of heat transferred to the medium M by the first heating unit 33 is increased when the support structure 70 is disposed on the support surface 61 compared to when the support structure 70 is not disposed on the support surface 61. As such, reductions in the amount of heat transferred to the medium M at the support section 60 can be compensated by the driving of the first heating unit 33. Thus, occurrences of heating deficiencies of the medium M at the support section 60 can be suppressed.

The exemplary embodiment described above may be modified as follows.

Figure 9:
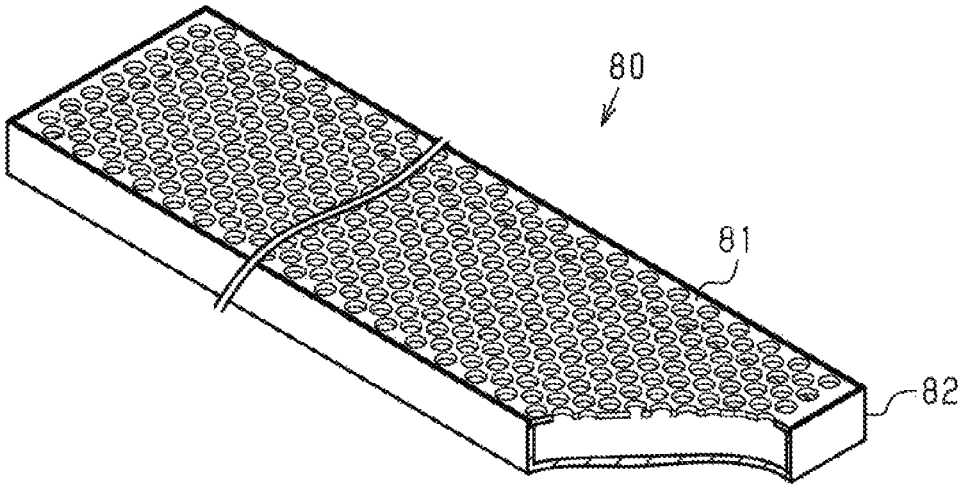
FIG. 9 is a perspective view illustrating a modified example of the support section.

The support structure 70 may be configured as a support structure 80 illustrated in FIG. 9. The support structure 80 illustrated in FIG. 9 is provided with a liquid permeable portion 81 that supports the medium M and through which ink passes, and a liquid reservoir 82 in which ink is stored. The liquid permeable portion 81 is a thin plate through which a plurality of holes is formed and may, for example, be a punched metal. Additionally, the liquid reservoir 82 is a container with a substantially rectangular box shape, and an opening thereof is covered by the liquid permeable portion 81.

The ink that has passed through the medium M can be made to pass through the liquid permeable portion 81 and be stored (held) in the liquid reservoir 82 even when printing is performed with the support structure 80 disposed on the support surface 61. Accordingly, even with this configuration, the advantageous effect (1) recited for the exemplary embodiment described above can be obtained. Additionally, in this support structure 80, the liquid reservoir 82 corresponds to an example of the liquid holding portion that holds the ink. Note that the advantageous effect (2) recited for the exemplary embodiment described above can be obtained by disposing a liquid absorbing portion capable of absorbing ink in the liquid reservoir 82.

The support structure 70 of this exemplary embodiment may be formed in a sheet shape suited for disposal on the support surface 61, or a member cut appropriately from a wound roll of the support structure 70 by the user of the printing apparatus 10 may be used.

The support structure 70 and the oblique portion 73 may be integrally formed.

The support structure 70 and the oblique portion 73 may be undetachable from the support surface 61.

An engaging portion may be provided for securing the support structure 70 to the support surface 61 when the support structure 70 is disposed on the support surface 61. Thus, even when the support structure 70 is attached to and detached from the support surface 61, the support structure 70 can always be disposed at a specific position.

Likewise, an engaging portion may be provided for securing the oblique portion 73 to the support surface 61 when the oblique portion 73 is disposed on the support surface 61. For example, the suction ports 62 open on the support surface 61 may be used as the engaging portion. Thus, even when the oblique portion 73 is attached to and detached from the support surface 61, the oblique portion 73 can always be disposed at a specific position. Additionally, the oblique portion 73 disposed at the specific position can be used to determine the disposal of the support structure 70 on the support surface 61.

The liquid permeable portion 71 may be provided separated by a space from the liquid absorbing portion 72. In this case, an air layer will be provided between the liquid permeable portion 71 and the liquid absorbing portion 72.

The liquid permeable portion 71 may be a nonwoven fabric, similar to the liquid absorbing portion 72. In this case, it is preferable that the density of the liquid permeable portion 71 be lower than the density of the liquid absorbing portion 72. In other words, it is preferable that the liquid permeable portion 71 be coarser than the liquid absorbing portion 72. As a result, liquid will easily migrate from the liquid permeable portion 71 to the liquid absorbing portion 72 but will not easily migrate from the liquid absorbing portion 72 to the liquid permeable portion 71.

The liquid absorbing portion 72 may be formed of a woven fabric. Additionally, the liquid absorbing portion 72 may be a sponge formed from resin, rubber, or the like.

When printing is continuously performed on the mesh-like medium M, there may be situations where the limit of ink that the liquid absorbing portion 72 of the support structure 70 is capable of absorbing is reached even though the roll R held in the feeding unit 20 has not been completely used. In such situations, printing failures may occur due to the printing being stopped to replace the support structure 70 or the printing being continued without attending to the situation. As such, it is preferable that the liquid absorbing portion 72 of the support structure 70 be designed to have a life that lasts at least until the printing on a new roll R has been completed.

In the exemplary embodiment described above, displacement of the landing position of the ink on the medium M is prevented by adjusting the gap GP to the appropriate gap regardless of whether or not the support structure 70 is disposed on the support surface 61. However, displacement of the landing position of the ink may be prevented through other methods.

The following statements can be made about the printing apparatus 10 that performs printing by discharging ink from the discharge section 54 supported on the carriage 52 toward the medium M while moving the carriage 52 in the width direction X. Specifically, the ink will land at a position separated from the intended landing position when the gap GP between the medium M and the discharge section 54 is large due to the fact that it takes a longer time for the ink to land on the medium M after being discharged from the discharge section 54. Additionally, the ink will land at a position separated from the intended landing position when the gap GP between the medium M and the discharge section 54 is small due to the fact that it takes a shorter time for the ink to land on the medium M after being discharged from the discharge section 54.

Here, when the gap adjustment is not carried out, displacement of the landing position of the ink on the medium M may be prevented by adjusting the discharge timing of the ink from the discharge section 54. Specifically, when the gap GP is larger than the appropriate gap, the discharge timing of the ink at the discharge section 54 may be shortened in accordance with the gap difference, and when the gap GP is smaller than the appropriate gap, the discharge timing of the ink at the discharge section 54 may be extended in accordance with the gap difference.

As a result, changes in the gap GP caused by the disposal or non-disposal of the support structure 70 can be handled, even in a printing apparatus 10 that does not include the raising/lowering mechanism 523.

The printing apparatus 10 may be provided with a winding unit configured to wind the medium M on which printing has been performed. In this case, tension may be applied to the medium M by controlling the feeding speed at the feeding unit 20 and the winding speed at the winding unit. As a result, the posture of the medium M during printing can be stabilized.

In the exemplary embodiment described above, the control unit 100 determines whether or not the support structure 70 is disposed on the support surface 61 on the basis of the detection results of the detection section 55, but need not make such a determination. For example, when the user has disposed the support structure 70 on the support surface 61, the user may configure the printing apparatus 10 as such, and the control unit 100 may determine whether or not the support structure 70 is disposed on the support surface 61 on the basis of that configuration.

The control unit 100 need not set the second target temperature of the second heating unit 34 in step S16 of the flowchart illustrated in FIG. 5. That is, when the support structure 70 is disposed on the support surface 61 for printing on the mesh-like medium M, the control unit 100 need not drive the second heating unit 34.

Even when the support structure 70 is disposed on the support surface 61 in step S11 of the flowchart illustrated in FIG. 5, the control unit 100 may proceed to the processing of step S12. That is, even when the support structure 70 is disposed on the support surface 61 for printing on the mesh-like medium M, the control unit 100 need not change the driving modes of the first heating unit 33 and the second heating unit 34.

The first heating unit 33 may be a heating unit that directly heats the medium M by irradiating the medium M with electromagnetic waves such as infrared rays.

Other than a medium M unwound from the roll R, the medium M may be a cutform medium M or a simple long medium M.

The liquid discharged or sprayed from the discharge section 54 is not limited to ink and, for example, may be a liquid material obtained by dispersing or mixing particles of a functional material in liquid, or the like. For example, a configuration is possible in which a liquid material, which includes material such as an electrode material, or a color material (pixel material) used in the manufacture of liquid crystal displays, electroluminescence (EL) displays, surface emitting displays, and the like in a dispersed or dissolved form, is discharged for recording.

This application claims priority under 35 U.S.C. § 119 to Japanese Patent Application No. 2016-102171, filed May 23, 2016. The entire disclosure of Japanese Patent Application No. 2016-102171 is hereby incorporated herein by reference.

What is claimed is:

1. A liquid discharging apparatus, comprising:

a support section comprising a support surface configured to selectively support a medium;

a discharge section configured to discharge liquid on the medium supported on the support section;

a transport unit configured to transport the medium in a transport direction; and a support structure configured to selectively contact the support surface and contact the medium, the support structure including:

a liquid permeable portion configured to contact and support the medium and allow liquid to pass there through, and a liquid holding portion configured to hold liquid that has passed through the liquid permeable portion.

2. The liquid discharging apparatus according to claim 1, wherein:

the liquid holding portion is a liquid absorbing portion configured to hold liquid by absorbing the liquid.

3. The liquid discharging apparatus according to claim 2, wherein:

the support section includes a support surface configured to support the medium; and the support structure is detachably disposed on the support surface.

4. The liquid discharging apparatus according to claim 2, wherein:

the support section includes an oblique portion detachably disposed on the support surface and configured to guide the medium to the support structure disposed on the support surface.

5. The liquid discharging apparatus according to claim 1, wherein:

the support structure is detachably disposed on the support surface.

6. The liquid discharging apparatus according to claim 5, wherein:

the support section includes an oblique portion detachably disposed on the support surface and configured to guide the medium to the support structure disposed on the support surface.

7. The liquid discharging apparatus according to claim 6, further comprising:

a first heating unit configured to heat the medium prior to being supported on the support section; and a second heating unit configured to heat the support section to heat the medium supported on the support section; wherein an amount of heat transferred to the medium by the first heating unit is increased when the support structure is disposed on the support surface compared to when the support structure is not disposed on the support surface.

8. The liquid discharging apparatus according to claim 5, further comprising:

a first heating unit configured to heat the medium prior to being supported on the support section; and a second heating unit configured to heat the support section to heat the medium supported on the support section; wherein an amount of heat transferred to the medium by the first heating unit is increased when the support structure is disposed on the support surface compared to when the support structure is not disposed on the support surface.

9. The liquid discharging apparatus according to claim 1, wherein the support surface comprises a plurality of suction hole for attaching the medium to a support surface of the support structure.

* * * * *